US005913519A

United States Patent [19]

Sindelar

[11] Patent Number: 5,913,519

[45] Date of Patent: Jun. 22, 1999

[54] THEATRICAL LEARNING GAME

[76] Inventor: Joseph A. Sindelar, 752 Westwind Dr., Bolingbrook, Ill. 60440

[21] Appl. No.: 08/909,474

[22] Filed: Aug. 11, 1997

[51] Int. Cl.[6] ..... A63F 3/00

[52] U.S. Cl. ..... 273/248; 273/431

[58] Field of Search ..... 273/242, 243, 273/248, 249, 429, 430, 431, 432

[56] References Cited

U.S. PATENT DOCUMENTS

| | | | |
|---|---|---|---|
| D. 270,741 | 9/1983 | Haney et al. | D21/35 |
| 4,557,485 | 12/1985 | Lardon | 273/249 |
| 4,566,698 | 1/1986 | Sneden | 273/249 |
| 4,907,808 | 3/1990 | Turner et al. | 273/240 |
| 4,940,239 | 7/1990 | Tuttle | 273/243 |
| 5,066,016 | 11/1991 | O'Neill | 273/249 |
| 5,145,184 | 9/1992 | Yearick et al. | 273/248 |

FOREIGN PATENT DOCUMENTS

| | | | |
|---|---|---|---|
| 2215222 | 9/1989 | United Kingdom | 273/243 |

OTHER PUBLICATIONS

Trival Pursuit, Master Game Rules of Play ©1981 pp. 1–4.

*Games* 1984 pp. 1–3.

*Primary Examiner*—William E. Stoll

*Attorney, Agent, or Firm*—Richard L Miller, P. E.

[57] ABSTRACT

A theatrical learning game that allows a player to learn theatrical facts as the game is played. The winner of the game gets an Oscar by correctly answering five theater category questions. The game includes a game board, at least one playing piece that is separate from and moves along the game board, a six-sided die that is separate from the game board and determines the amount of movement of the at least one playing piece along the game board, and at least one deck of cards that is separate from the game board and based upon answers given to questions thereon determines whether a player gets another turn or loses a turn.

9 Claims, 8 Drawing Sheets

THEATRE CARDS

QUESTION CARDS

THEATRICAL LEARNING GAME

CROSS REFERENCE TO RELATED APPLICATIONS

The instant application contains subject matter disclosed in applicant's Disclosure Document No. 408810 filed on Nov. 21, 1996. And as such, it is respectfully requested that this Disclosure Document be relied upon and remain a permanent part of the file history during the prosecution of the instant application and during any subsequent action thereof.

BACKGROUND OF THE INVENTION

The present invention relates to a learning game. More particularly, the present invention relates to a theatrical learning game.

SUMMARY OF THE INVENTION

ACCORDINGLY, AN OBJECT of the present invention is to provide a theatrical learning game that avoids the disadvantages of the prior art.

ANOTHER OBJECT of the present invention is to provide a theatrical learning game that is simple and inexpensive to manufacture.

STILL ANOTHER OBJECT of the present invention is to provide a theatrical learning game that is simple to use.

BRIEFLY STATED, YET ANOTHER OBJECT of the present invention is to provide a theatrical learning game that allows a player to learn theatrical facts as the game is played. The winner of the game gets an Oscar by correctly answering five theater category questions. The game includes a game board, at least one playing piece that is separate from and moves along the game board, a six-sided die that is separate from the game board and determines the amount of movement of the at least one playing piece along the game board, and at least one deck of cards that is separate from the game board and based upon answers given to questions thereon determines whether a player gets another turn or loses a turn.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures on the drawing are briefly described as follows.

LIST OF REFERENCE NUMERALS UTILIZED IN THE DRAWING

Figure 1:
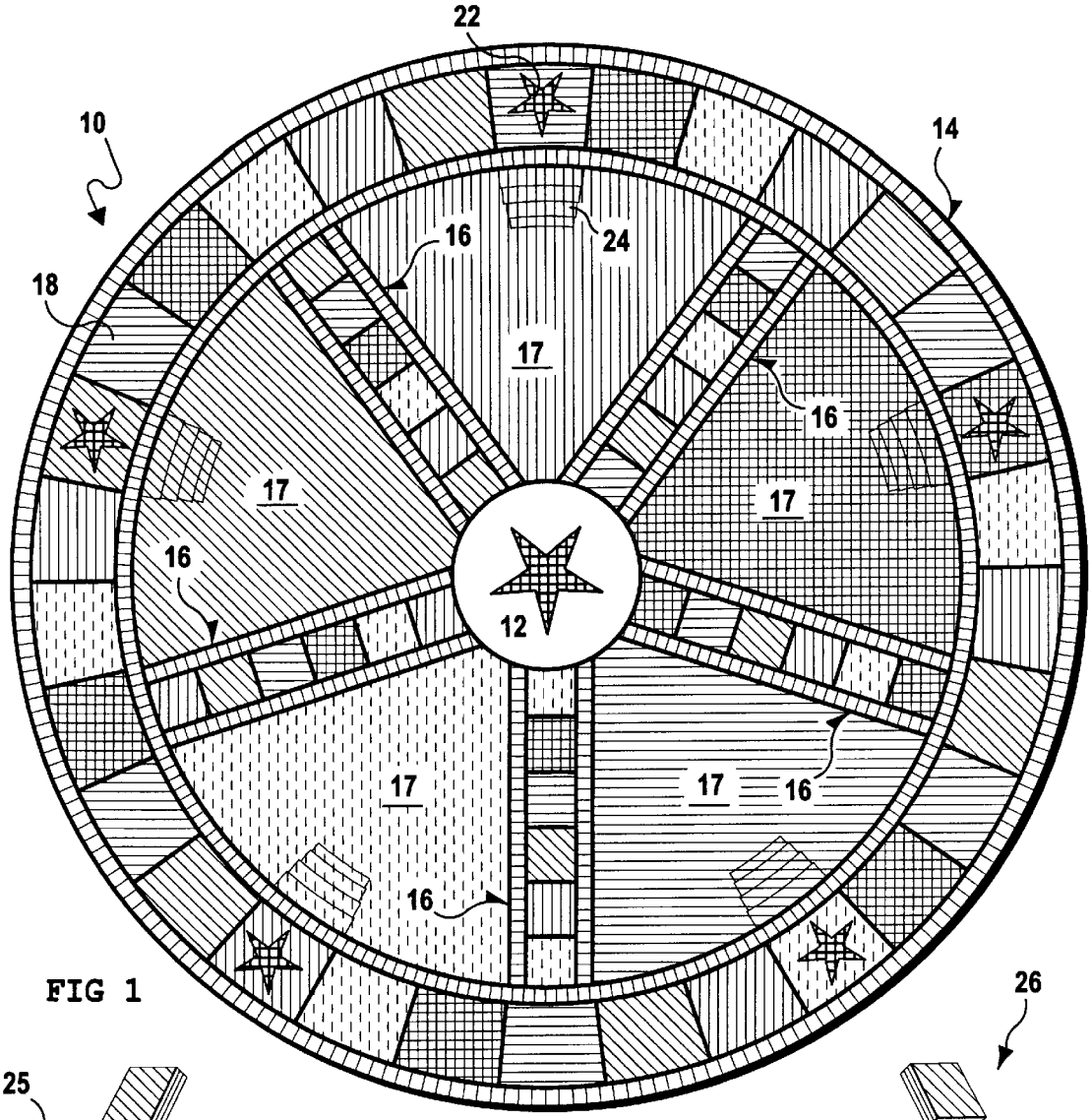
FIG. 1 is a diagrammatic top plan view of the game board of the present invention.

10 game board of the theatrical learning game of present invention
12 center of game board 10
14 peripheral path of game board 10
16 five radial paths of game board 10
17 five theaters of game board 10
18 plurality of peripheral playing spaces of peripheral path 14 of game board 10
20 plurality of radial playing spaces 20 of each of five radial paths 16 of game board 10
22 star of game board 10
24 steps of game board 10
25 five differently colored decks of theater cards of theatrical learning game of the present invention
26 five differently colored decks of question cards of present invention
28 six-sided die of present invention
30 five differently colored playing pieces of present invention

DETAILED DESCRIPTION OF THE PREFERRED EMBODIMENT

Referring now to the figures in which like numerals indicate like parts, and particularly to FIG. 1, the game board of the theatrical learning game of the present invention is shown generally at 10.

The game board 10 is circular-shaped and has a center space 12, a peripheral path 14 that extends continuously around its periphery, and five radial paths 16 that are equally spaced-apart and extend continuously radially outwardly from the center 12 of the game board 10 to the peripheral path 14 of the game board 10, and divide the game board 10 into five theaters 17

The peripheral path 14 of the game board 10 is divided into a plurality of peripheral playing spaces 18 which are color coded to represent five categories comprising red for horror, blue for comedy, green for drama, purple for action/adventure, and yellow for science fiction.

Each of the five radial paths 16 of the game board 10 is divided into a plurality of radial playing spaces 20 which are also color coded to represent one of the five categories comprising red for horror, blue for comedy, green for drama, purple for action/adventure, and yellow for science fiction.

The five theaters 17 of the game board 10 are also color coded with each representing a different one of the five categories comprising red for horror, blue for comedy, green for drama, purple for action/adventure, and yellow for science fiction.

A space of the plurality of peripheral playing spaces 18 of the peripheral path 14 of the game board 10 that is equidistant between each pair of radial paths 16 of the game board 10 includes a star 22 that represent star entrances into the five theaters 17 of the game board 10, with steps 24 extending radially inwardly therefrom into the five theaters 17 of the game board 10.

Figure 2:
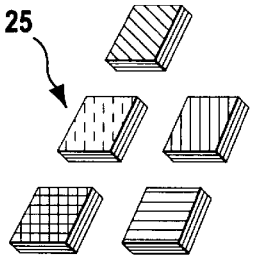
FIG. 2 is a diagrammatic perspective view of the deferentially colored decks of theater cards of the present invention.

As shown in FIG. 2, the theatrical learning game further includes five differently colored decks of theater cards 25 which are also color coded to represent one of the five categories comprising red for horror, blue for comedy, green for drama, purple for action/adventure, and yellow for science fiction.

Each deck of the five differently colored decks of theater cards 25 has questions on one face thereof that corresponds to the category of its color, with the answer being on an opposite face thereof.

Figure 3:
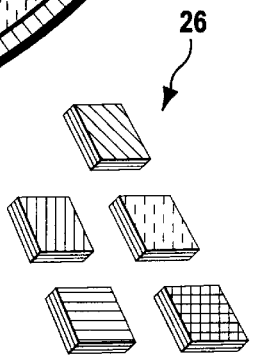
FIG. 3 is a diagrammatic perspective view of the differentially colored decks of question cards of the present invention.
Figure 6A:
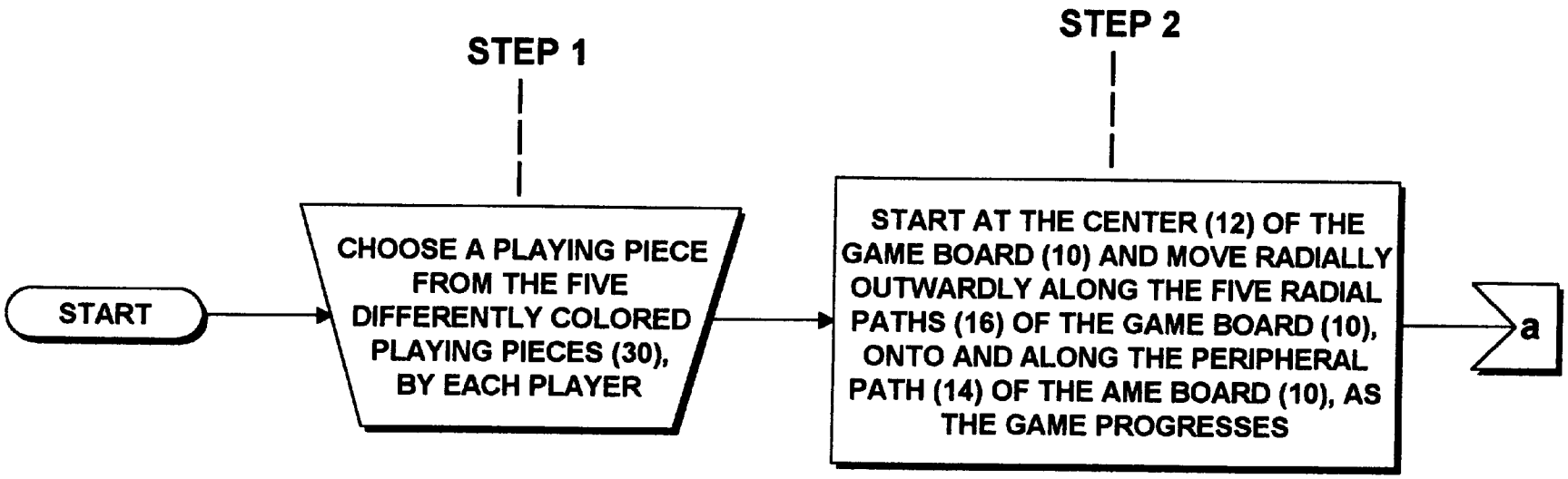
FIG. 6A–6G is a process flow of the steps for playing the game of the present invention.
Figure 6B:
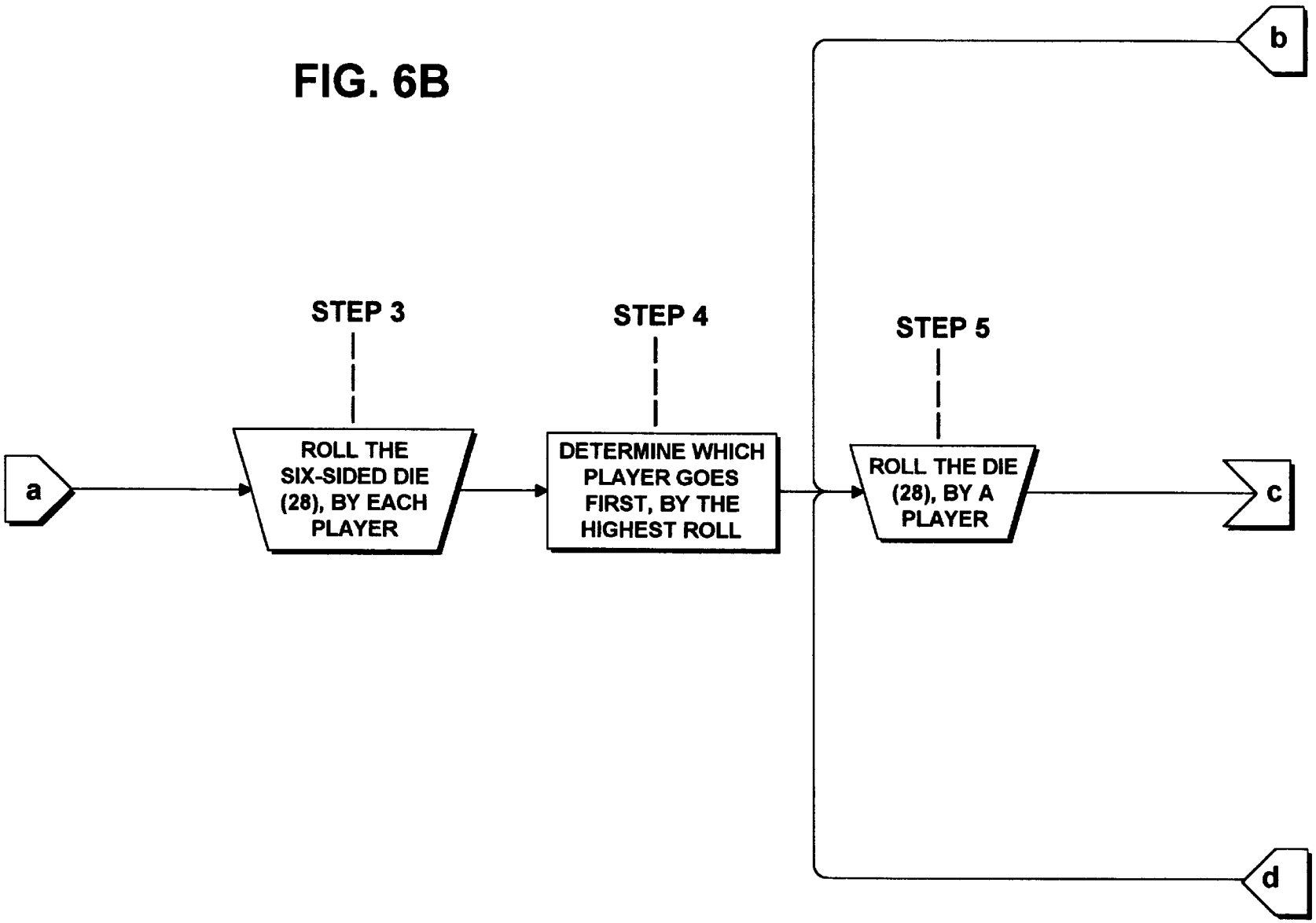
Figure 6C:
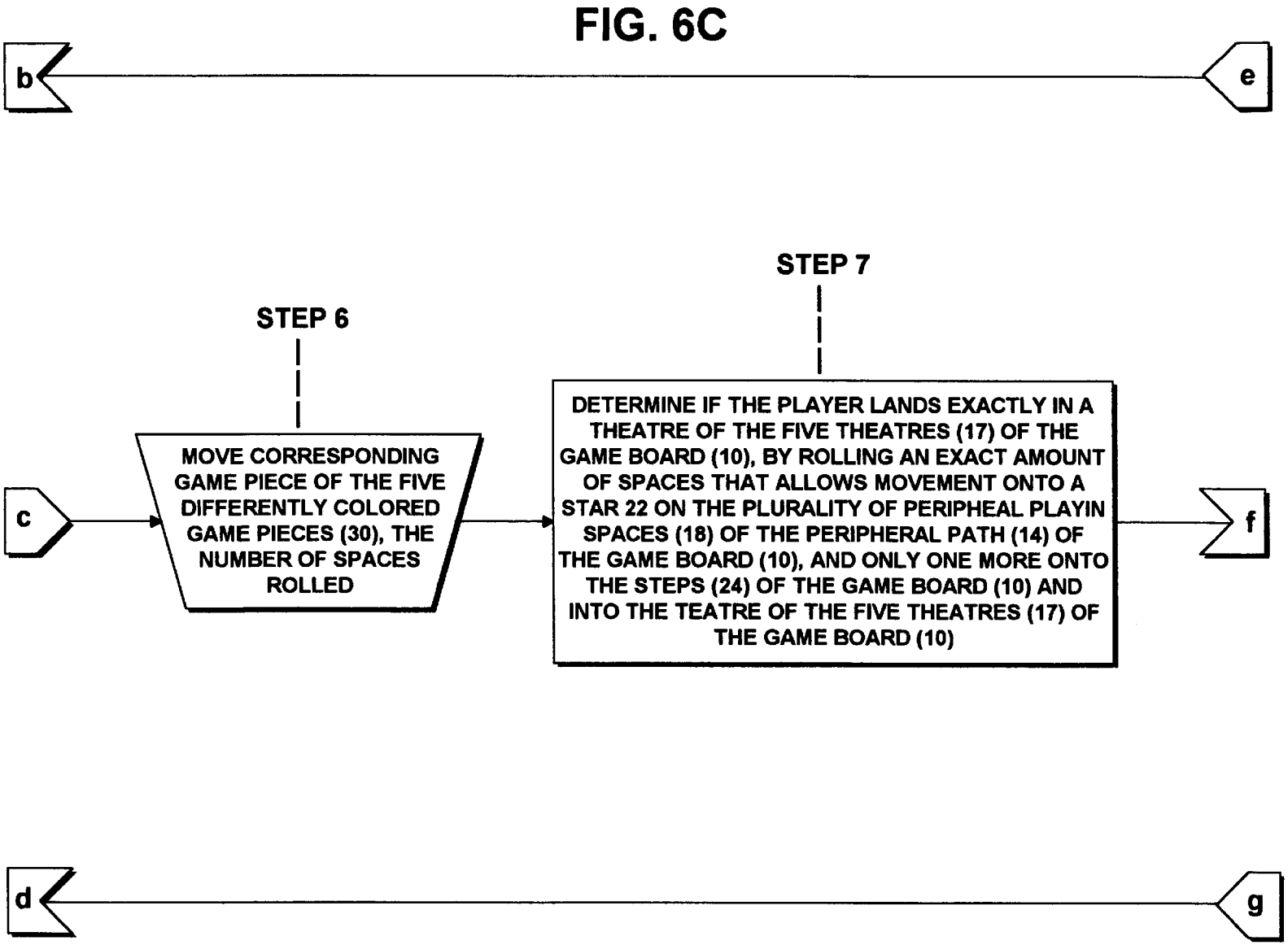
Figure 6D:
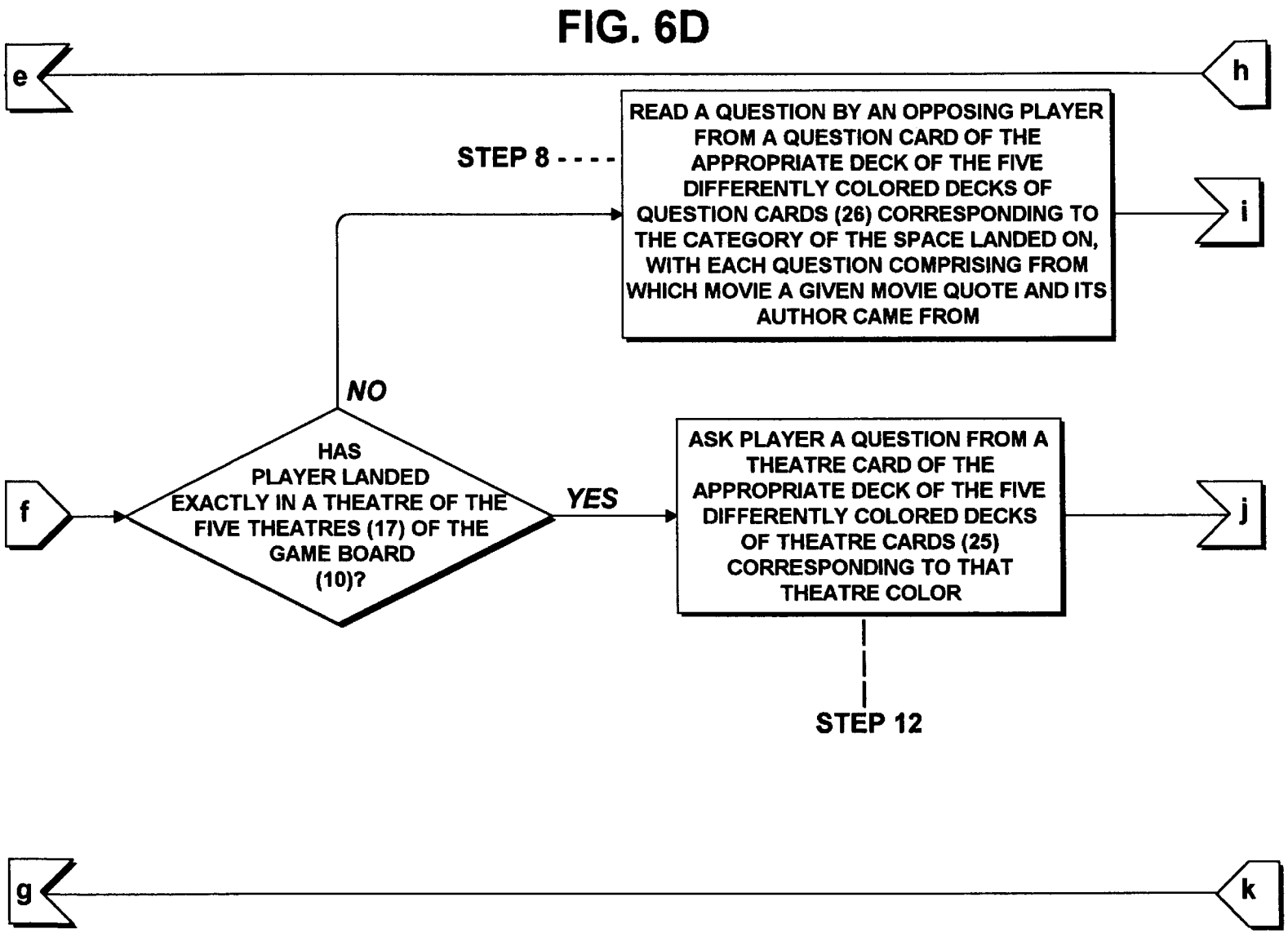
Figure 6E:
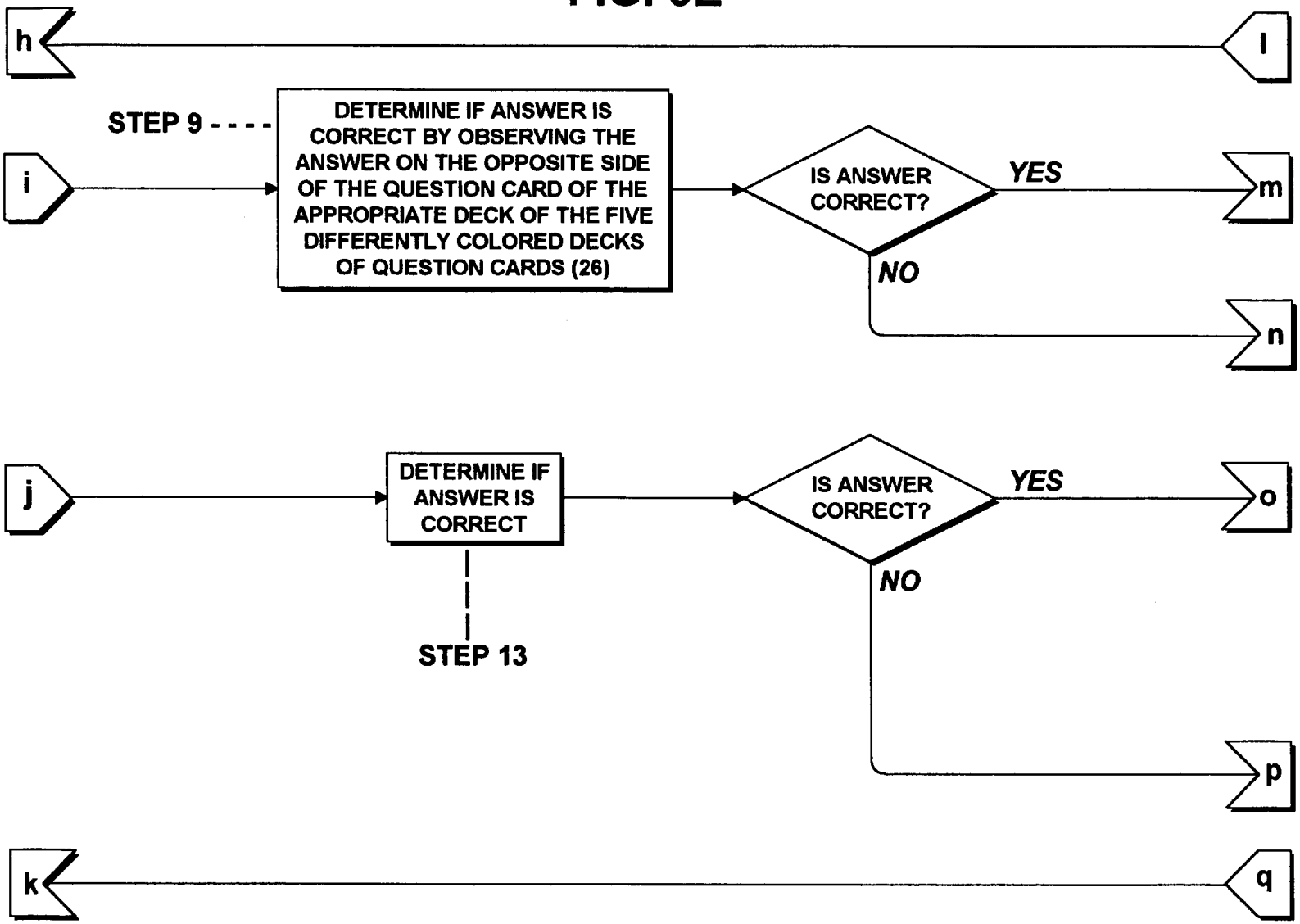
Figure 6F:
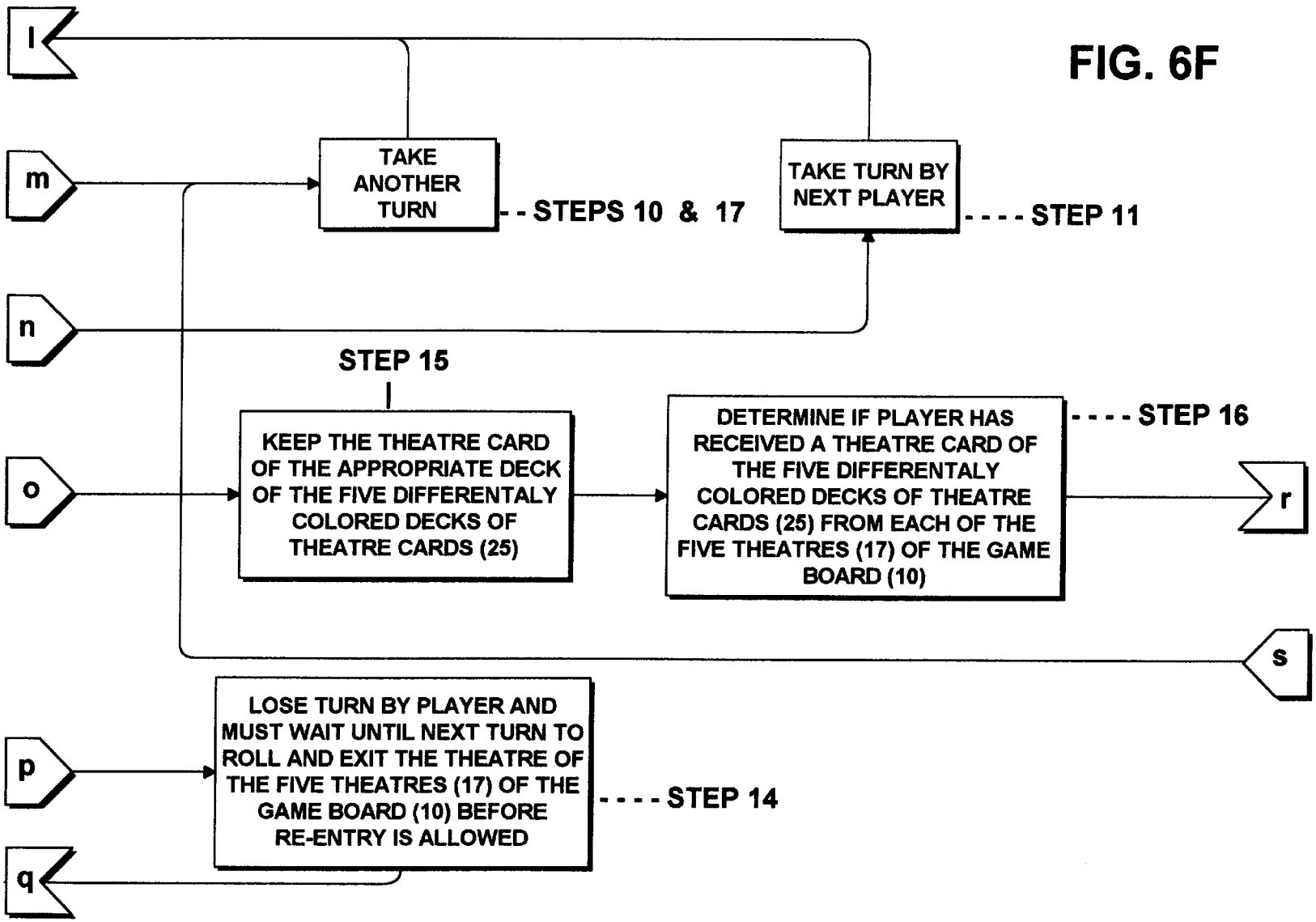
Figure 6G:
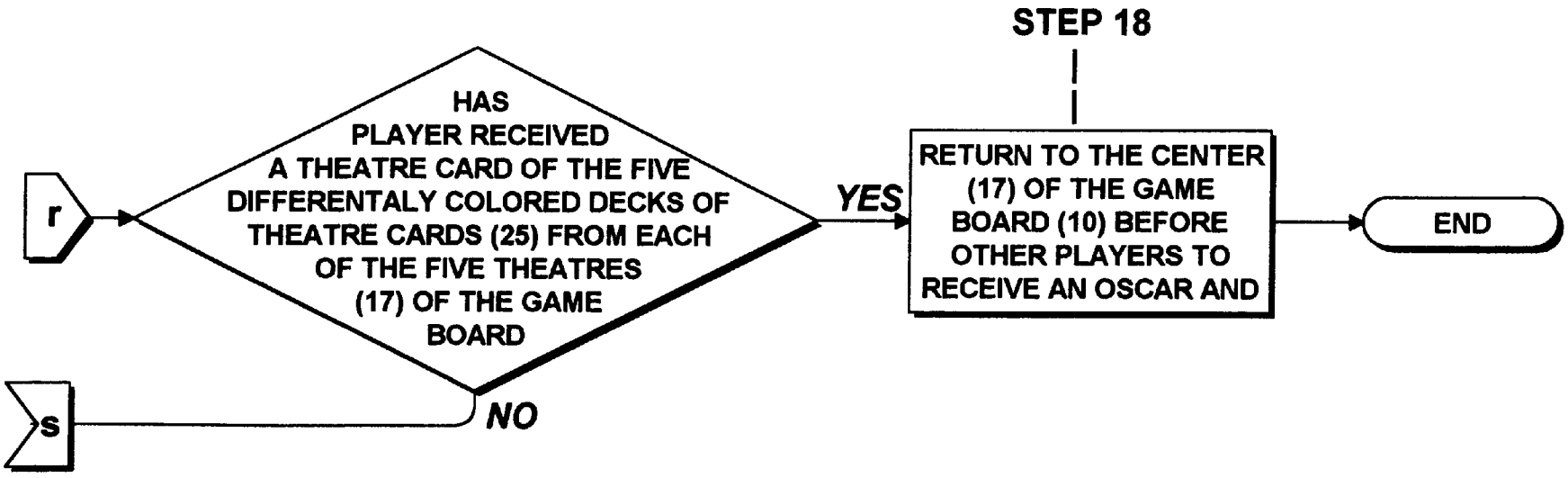

As shown in FIG. 3, the theatrical learning game further includes five differently colored decks of question cards 26 which are also color coded to represent one of the five categories comprising red for horror, blue for comedy, green for drama, purple for action/adventure, and yellow for science fiction.

Each deck of the five differently colored decks of question cards 26 has questions on one face thereof that correspond to the category of its color, with the question comprising from what movie a given quote and speaker was taken, and with the answer being on an opposite face thereof.

Figure 4:
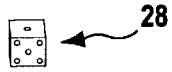
FIG. 4 is a diagrammatic perspective view of the die of the present invention.

As shown in FIG. 4, the theatrical learning game further includes a six-sided die 28.

Figure 5:
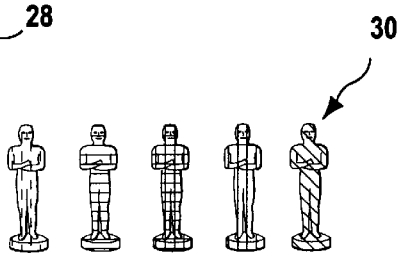
FIG. 5 is a diagrammatic perspective view of the five differently colored playing pieces of present invention

As shown in FIG. 5, the theatrical learning game further includes five differently colored playing pieces 30 in the shape of Oscars.

The steps for playing the theatrical learning game can best be seen in FIGS. 6A–6G, and as such will be discussed with reference thereto.

STEP 1: Choose a playing piece from the five differently colored playing pieces 30, by each player.

STEP 2: Start at the center 12 of the game board 10 and move radially outwardly along the five radial paths 16 of the game board 10, onto and along the peripheral path 14 of the game board, as the game progresses.

STEP 3: Roll the six-sided die 28, by each player.

STEP 4: Determine which player goes first, by the highest roll.

STEP 5: Roll the six-sided die 28, by a player.

STEP 6: Move corresponding playing piece of the five differently colored playing pieces 30, the number of spaces rolled.

STEP 7: Determine if the player lands exactly in a theater of the five theaters 17 of the game board 10, by rolling an exact amount of spaces that allows movement onto a star 22 on the plurality of peripheral playing spaces 18 of the peripheral path 14 of the game board 10 and, only one more onto the steps 24 of the game board 10 and into the theater of the five theaters 17 of the game board 10.

STEP 8: Read a question by an opposing player from a question card of the appropriate deck of the five differently colored decks of question cards 26 corresponding to the category of the space landed, with each question comprising from which movie a given quote and its author came from, if answer to step 7 is no.

STEP 9: Determine if answer is correct by observing the answer on the opposite side of the question card of the appropriate deck of the five differently colored decks of question cards 26.

STEP 10: Take another turn by returning to step 5, if answer to step 9 is yes.

STEP 11: Take turn by next player by returning to step 5, if answer to step 9 is no.

STEP 12: Ask player a question from a theater card of the appropriate deck of the five differently colored decks of theater cards 25 corresponding to that theater color, if answer to step 7 is yes.

STEP 13: Determine if answer is correct.

STEP 14: Lose turn by player and wait until next turn to roll and exit the theater of the five theaters 17 of the game board 10 before re-entry is allowed, if answer to step 13 is no.

STEP 15: Keep the theater card of the appropriate deck of the five differently colored decks of theater cards 25, if answer to step 13 is yes.

STEP 16: Determine if player has received a theater card of the five differently colored decks of theater cards 25 from each of the five theaters 17 of the game board 10.

STEP 17: Take another turn by returning to step 5, if answer to step 16 is no.

STEP 18: Return to the center 17 of the game board 10 before other players to receive an Oscar and win the game, if answer to step 16 is yes.

It will be understood that each of the elements described above, or two or more together, may also find a useful application in other types of constructions differing from the types described above.

While the invention has been illustrated and described as embodied in a theatrical learning game, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A theatrical learning game, comprising:

a) a game board; said game board being circular-shaped and having a center space, a peripheral path extending continuously around its periphery and divided into a plurality of peripheral playing spaces, and five radial paths being equally spaced-apart and extending continuously radially outwardly from said center of said game board to said peripheral path of said game board, and dividing said game board into five theaters; a space of said plurality of peripheral playing spaces of said peripheral path of said game board being equidistant between each pair of radial paths of said five radial paths of said game board including a star representing star entrances into said five theaters of said game board, with steps extending radially inwardly therefrom into said five theaters of said game board;

b) at least one playing piece being separate from and moving along said game board;

c) a six-sided die being separate from said game board and determining amount of movement of said at least one playing piece along said game board; and d) at least one deck of cards being separate from said game board and determining whether a player loses a turn.

2. The game as defined in claim 1, wherein said plurality of peripheral playing spaces of said peripheral path of said game board are color coded to represent five categories comprising red for horror, blue for comedy, green for drama, purple for action/adventure, and yellow for science fiction.

3. The game as defined in claim 1, wherein each of said five radial paths of said game board is divided into a plurality of radial playing spaces which are color coded to represent one of five categories comprising red for horror, blue for comedy, green for drama, purple for action/adventure, and yellow for science fiction.

4. The game as defined in claim 1, wherein said five theaters of said game board are color coded with each representing a different one of five categories comprising red for horror, blue for comedy, green for drama, purple for action/adventure, and yellow for science fiction.

5. The game as defined in claim 1, wherein said at least one playing piece is five differently colored playing pieces shaped as Oscars.

6. The game as defined in claim 1, wherein said at least one deck of cards is five differently colored decks of theater cards which are color coded to represent one of five categories comprising red for horror, blue for comedy, green for drama, purple for action/adventure, and yellow for science fiction.

7. The game as defined in claim 6, wherein each deck of said five differently colored decks of theater cards has questions on one face thereof that corresponds to said category of its color, with an answer being on an opposite face thereof.

8. The game as defined in claim 1, wherein said at least one deck of cards is five differently colored decks of question cards which are color coded to represent one of five categories comprising red for horror, blue for comedy, green for drama, purple for action/adventure, and yellow for science fiction.

9. The game as defined in claim 8, wherein each deck of said five differently colored decks of question cards has questions on one face thereof that correspond to said category of its color, with said question being from what movie a given quote and speaker was taken, and with an answer being on an opposite face thereof.

* * * * *